US007675475B2

(12) United States Patent
Brandstetter

(10) Patent No.: US 7,675,475 B2
(45) Date of Patent: Mar. 9, 2010

(54) ANTENNA MOUNT

(75) Inventor: John R. Brandstetter, West Islip, NY (US)

(73) Assignee: Honeywell International Inc., Morristown, NJ (US)

( * ) Notice: Subject to any disclaimer, the term of this patent is extended or adjusted under 35 U.S.C. 154(b) by 191 days.

(21) Appl. No.: 12/103,395

(22) Filed: Apr. 15, 2008

(65) Prior Publication Data

US 2009/0256776 A1 Oct. 15, 2009

(51) Int. Cl.
*H01Q 1/12* (2006.01)

(52) U.S. Cl. ..... 343/878; 343/880

(58) Field of Classification Search ..... 343/878, 343/880, 881, 883, 886
See application file for complete search history.

(56) References Cited

U.S. PATENT DOCUMENTS 6,788,256 B2 9/2004 Hollister
6,947,009 B2 * 9/2005 Kim et al. ..... 343/893
7,321,788 B2 1/2008 Addy et al.
7,358,927 B2 * 4/2008 Luebke et al. ..... 343/907
2005/0122271 A1 * 6/2005 Pecora et al. ..... 343/719
2008/0024304 A1 1/2008 Bergman et al.

* cited by examiner

*Primary Examiner*—Hoang V Nguyen
(74) *Attorney, Agent, or Firm*—Husch Blackwell Sanders Welsh & Katz

(57) ABSTRACT

The present invention relates to a mounted antenna for use in a wireless communication system, and in particular, to a mounting device and associated method for mounting an antenna within a cavity of a finished wall. The mounting device comprises a platform and a plurality of support legs, each of the plurality of support legs having a free end and a fixed end. The fixed end is pivotally coupled to the platform. The platform has a coupling mechanism for attaching an antenna to the platform. The mounting device also includes a biasing element for supplying a constant force to the plurality of support legs sufficient to propel the free end of each support leg in an outwardly direction from the platform and engage a surface within a wall cavity to support the mounting device.

21 Claims, 4 Drawing Sheets

ANTENNA MOUNT

FIELD OF THE INVENTION

The present invention relates to a mounted antenna for use in a wireless communication system, and in particular, to a mounting device and associated method for mounting an antenna within a cavity of a finished wall.

BACKGROUND OF THE INVENTION

In home-based security systems, cellular radios can be used to send and receive alarm messages to and from a central receiving station. Radio frequency (RF) waves used in cellular communications propagate in the line of sight. As such, communication between the cellular radio and a cellular tower degrades as the distance between the tower and the radio increases. Mounting the antenna as high as possible within the building reduces the effect of the line of site problem and improves the reliability of communications between the building and the cell tower.

Conventional security systems typically mount the antennas to walls or ceilings. Mounting the antenna as high as possible eliminates the effects of common obstructions such as furniture, appliances and neighboring structures. Unfortunately, wall mounted antennas for indoor wireless security systems are often bulky and unsightly and will not provide adequate RF performance because they are situated in a low position within the building.

One attempted solution to the aforementioned problem is to hide the antenna in the floor, walls, and/or ceiling and mount the antenna as high as possible within the building. This allows for an effective security system having improved RF performance without the drawback of a bulky and unsightly antenna device. A problem that arises with this attempted solution is the prohibitive construction costs associated with installing the antenna within existing structures. It is often difficult to mount the antenna as high as possible within a wall cavity without drilling or cutting any additional or larger holes than would ordinarily be required to install the central control panel on an exterior surface of the wall.

Therefore, what is needed in the art is a device and method for quickly mounting an antenna in an elevated position within a wall cavity without having to cut any larger or additional holes in the finished wall.

BRIEF SUMMARY OF THE INVENTION

In one exemplary embodiment, the invention is directed to a mounting device, comprising a platform and a plurality of support legs, each of the plurality of support legs having a free end and a fixed end. The fixed end is pivotally coupled to the platform. The platform has a coupling mechanism for attaching an antenna to the platform. The mounting device also includes a biasing element for supplying a constant force to the plurality of support legs sufficient to propel the free end of each support leg in an outwardly direction from the platform and engage a surface within a wall cavity to support the mounting device.

In one embodiment of the invention, each of the plurality of support legs comprises a fastener coupled to the free end thereof for securing each of the plurality of support legs to a vertical surface within the wall cavity.

In another embodiment of the invention, the fastener includes a set of metal barbs.

In another embodiment of the invention, the fastener includes an elastomer end cap.

In another embodiment of the invention, the fastener includes a set plastic barbs molded into the free ends of each support leg.

In another embodiment of the invention, each of the plurality of support legs has a generally curvilinear profile.

In another embodiment of the invention, the biasing element includes a spring.

In another embodiment of the invention, the coupling mechanism includes an opening in the platform.

In another embodiment of the invention, the plurality of support legs comprises two pairs of support legs.

In another embodiment of the invention, the plurality of support legs comprises four (4) support legs.

In another embodiment of the invention, each of the plurality of support legs are drawn to a generally perpendicular position relative to a bottom surface of the platform when the plurality of support legs is collapsed.

In another exemplary embodiment, the present invention is directed to a method of mounting an antenna, comprising providing a platform and a plurality of support legs coupled to the platform. The platform has a coupling mechanism for attaching an antenna to the platform. A biasing element is further provided for supplying a constant force to the plurality of support legs sufficient to propel a free end of each support leg in an outwardly direction from the platform and engage a surface within a wall cavity to support the antenna and the platform. The plurality of support legs is collapsed to a generally perpendicular position relative to a bottom surface of the platform and the antenna and the platform are inserted into a wall cavity through an opening in the finished wall. Each of the plurality of support legs is secured to a surface within the wall cavity to support the antenna and the platform.

In another embodiment of the invention, the surface within the wall cavity is a vertical surface.

In another embodiment of the invention, a deflector is positioned in the wall cavity to guide the antenna and the platform to the elevated position within the wall cavity.

In another embodiment of the invention, positioning the deflector includes sliding at least one of the plurality of support legs along a sloped surface of the deflector.

In another exemplary embodiment, the present invention is directed to an system for mounting an antenna within a wall cavity, the system comprising a platform and a plurality of support legs. Each of the plurality of support legs has a free end and a fixed end, the fixed end pivotally coupled to the platform. The system further comprises a biasing element for supplying a constant force to the plurality of support legs sufficient to propel the free end of each support leg in an outwardly direction from the platform and secure the free end of each of the plurality of support legs to a vertical surface within a wall cavity. This maintains the position of the mounting device in an elevated position within the wall cavity. A deflector is provided for guiding the antenna and the platform to the elevated position within the wall cavity.

In another embodiment of the invention, the plurality of support legs is drawn to a generally perpendicular position relative to a bottom surface of the platform when the plurality of support legs is collapsed.

In another embodiment of the invention, the plurality of support legs is propelled outwardly from the platform to a generally expanded position when the plurality of support legs is secured to the vertical surface within the wall cavity.

In another embodiment of the invention, the platform has an opening for coupling an antenna to the platform.

In another embodiment of the invention, the deflector includes a sloped surface on which at least one of the plurality of support legs slides as the antenna and platform are positioned in the wall cavity.

In another embodiment of the invention, the deflector includes an overhang portion.

DETAILED DESCRIPTION OF THE INVENTION

Figure 1A:
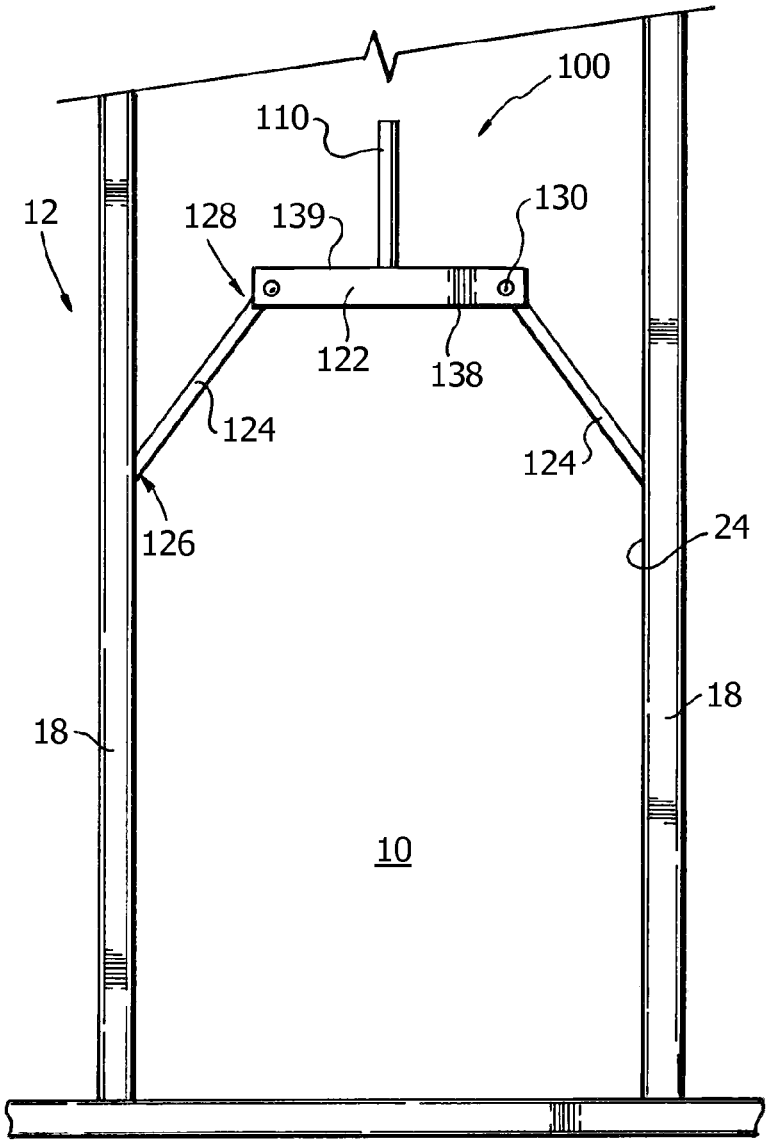
FIG. 1A illustrates a cross-sectional front view of an antenna and a mounting device within a cavity of a finished wall according to an embodiment of the present invention.

The present invention, which provides a mounting device having support legs coupled to a platform for supporting the mounting device within a wall cavity of a finished wall, as well as methods of doing the same, will now be described in greater detail by referring to the drawings that accompany the present application. It is noted that the drawings of the present application are provided for illustrative purposes and are thus not drawn to scale.

Figure 1B:
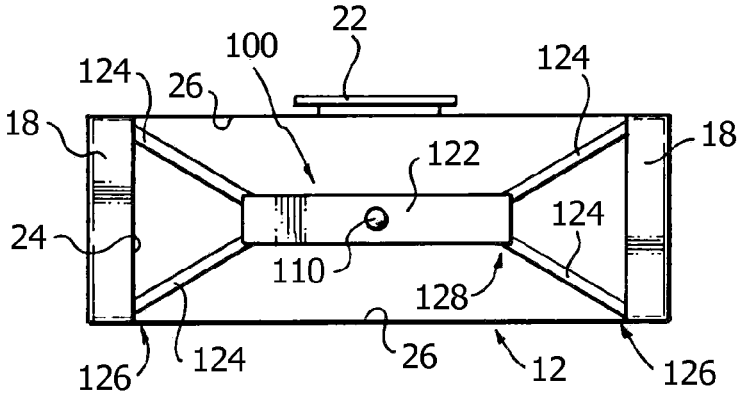
FIG. 1B illustrates a cross-sectional top view of the antenna and the mounting device of FIG. 1A within a cavity of a finished wall.

Aspects of the invention will be described first with reference to FIGS. 1A-1B, which depict a mounting device 100 within a wall cavity 10 of a finished wall 12 according to the present invention. The finished wall 12 may be a conventional finished interior wall covered with, for example, drywall, gypsum board, plasterboard or other similar material. However, it can be appreciated that the finished wall 12 may consist of any material that covers the wall cavity 10 and associated wall studs 18 with relative permanency. As will be further described herein, the finished wall 12 includes a central control panel 22 mounted thereon, as is conventionally used for controlling home-based security systems.

The mounting device 100 includes a platform 122 and a plurality of support legs 124 coupled to the platform 122. Each of the plurality of support legs 124 has a free end 126 and a fixed end 128, the fixed end 128 pivotally coupled to the platform 122. As shown in FIGS. 1A-1B, the plurality of support legs 124 comprises four (4) support legs extending from a bottom surface 138 of the platform to support the weight of the combination antenna and mounting device 100 equally. The fixed ends 128 of each support leg 124 are pivotally coupled to the platform 122 to allow the plurality of support legs 124 to be propelled outwardly from the platform 122 to a generally expanded position when the plurality of support legs 124 is secured to a vertical surface 24 within the wall cavity 10. The plurality of support legs can also be drawn to a generally perpendicular position relative to the bottom surface 138 of the platform 122 when the plurality of support legs 124 is collapsed.

The mounting device 100 includes biasing elements 130 for supplying a constant force to the plurality of support legs 124 sufficient to propel the free end 126 of each support leg 124 in an outwardly direction from the platform 122 and engage the vertical surface 24 within the wall cavity 10 to support the mounting device 100. As shown in the cutaway view of FIG. 2B, the biasing element 130 may include a spring coupled to each support leg 124 for supplying the necessary force to each support leg 124. However, it can be appreciated that the biasing element 130 may include any device capable of providing the necessary force to support the mounting device 100 within the wall cavity 10.

Figure 2A:
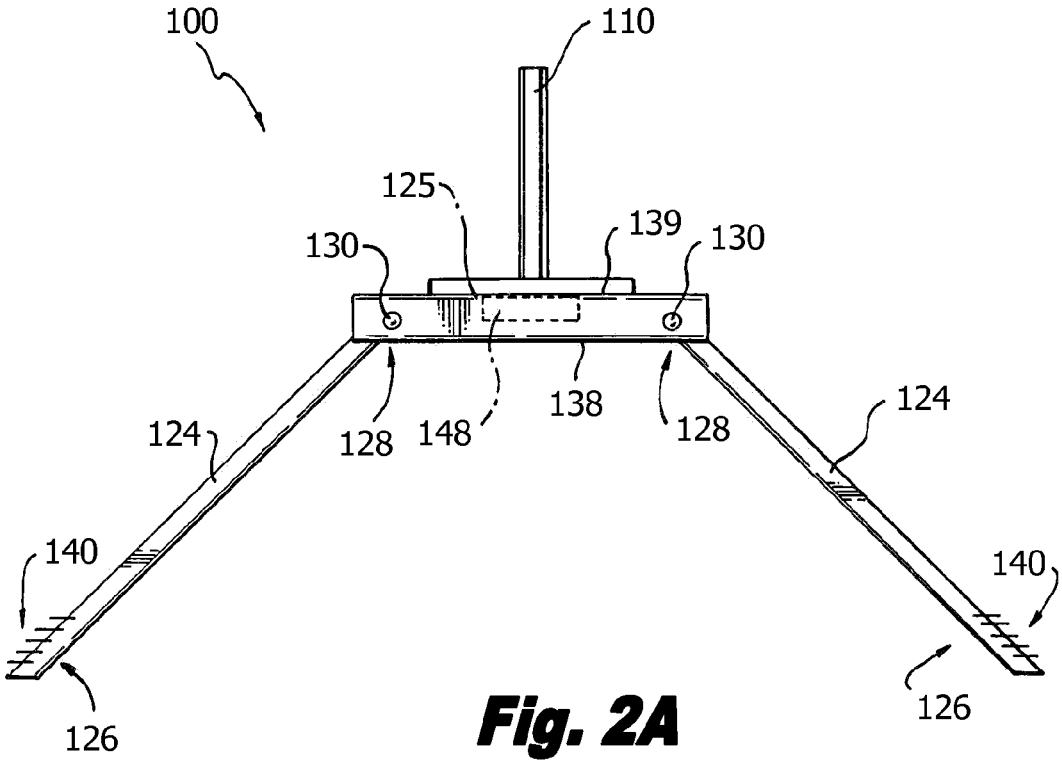
FIG. 2A illustrates a front view of the antenna and the mounting device of FIGS. 1A-1B.
Figure 2B:
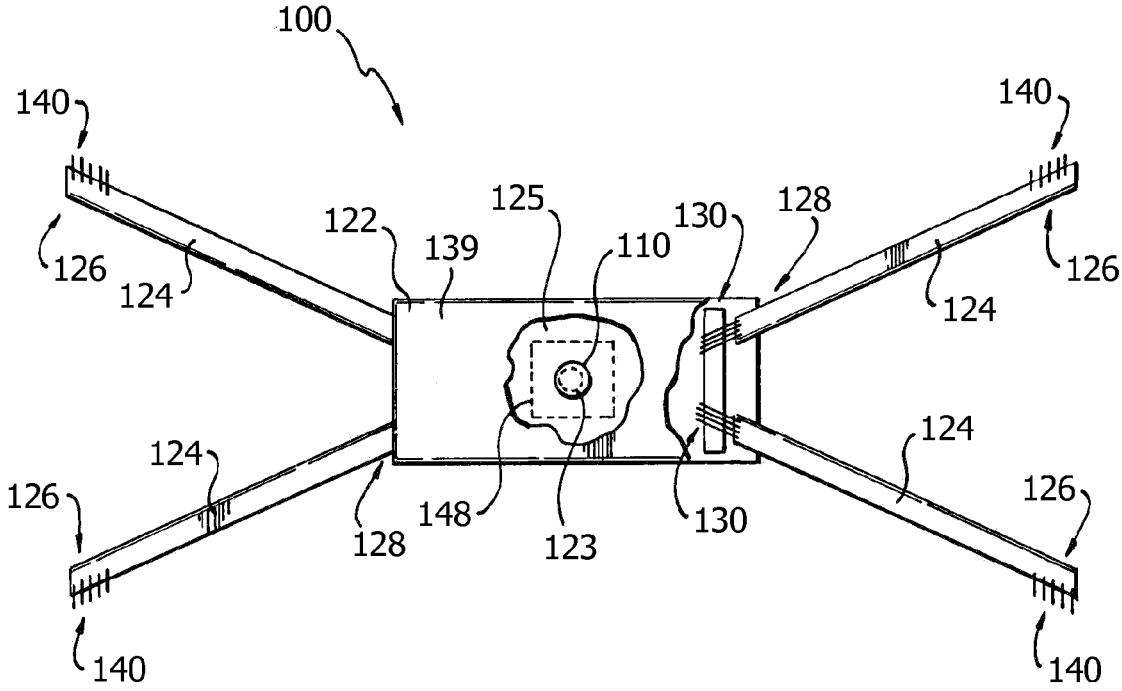
FIG. 2B illustrates a top view of the antenna and the mounting device of FIGS. 1A-1B.

As best shown in FIG. 2B, the platform 122 includes a coupling mechanism 123 for attaching an antenna I 1O to a surface 139 of the platform 122. In the exemplary embodiment shown in FIG. 2B, the coupling mechanism 123 comprises an opening in the platform 122 for coupling the antenna 110 to the platform 122. In one embodiment, the opening may include serrated edges (not shown) for gripping the antenna 110. However, it can be appreciated that the coupling mechanism 123 may include any number of different mechanisms for attaching an antenna 110 to the platform 122.

In a preferred embodiment of the invention, the antenna 10 is a radio frequency (RF) antenna suitable for communicating an alarm signal generated by the central control panel 22 to a communication tower (not shown). The RF antenna may be combined with a ground plane 125 (shown in FIGS. 2A-2B) used for controlling the impedance of the RF signal path. It can be appreciated that the antenna 10 can be used for radio and television broadcasting, point-to-point radio communication, cellular communications, wireless local area networks (LAN), radar, or any other similar system.

As shown in FIGS. 2A-2B, each of the plurality of support legs 124 includes a fastener 140 coupled to the free end 128 thereof for securing each of the plurality of support legs 124 to the vertical surface 24 within the wall cavity 10. In the exemplary embodiment shown in FIGS. 2A-2B, the fastener 140 comprises a set of metal barbs protruding from the free end 128 of each support leg 124. The weight of the antenna 110 and the mounting device 100, as well as the constant force from the plurality of support legs 24, causes the barbs to penetrate into the vertical surface 24. Alternatively, the fastener 140 may include an elastomer end cap (not shown), such as rubber or vinyl, to provide friction between the support legs 124 and the vertical surface 24. As best shown in FIG. 11B, the fastener 140 may be secured to the vertical surface 24 of the wall studs 18, an inner surface 26 of the finished wall 12, or the intersection of the wall studs 18 and the inner surface 26.

Figure 3A:
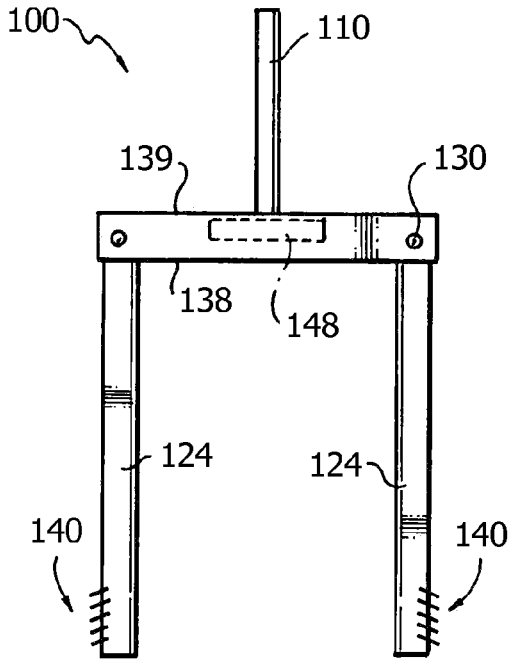
FIG. 3A illustrates a front view of the antenna and the mounting device of FIGS. 1-2 in a collapsed, pre-installation position.
Figure 3B:
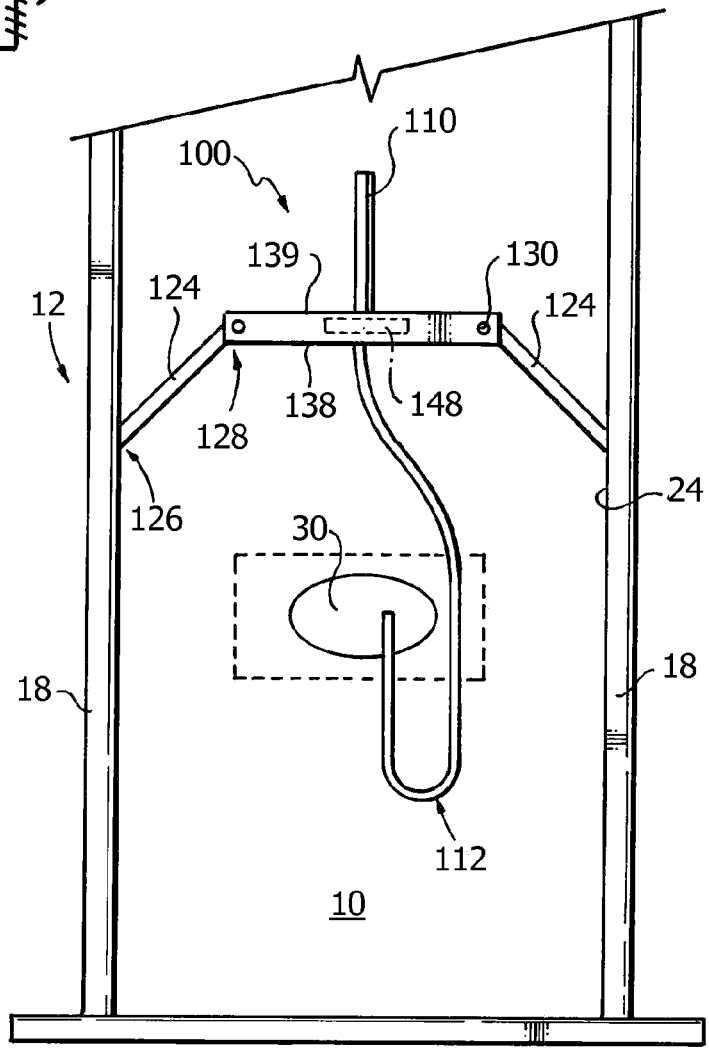
FIG. 3B illustrates a cross-sectional front view of the combination antenna and mounting device of FIGS. 1-2 within the cavity of the finished wall.

A method of mounting the antenna 110 within the finished wall 12 according to an embodiment of the invention will now be described with reference to FIGS. 3A-3B. First, as shown in FIG. 3A, a technician installing the mounting device 100 positions the plurality of support legs 124 to a pre-installation position, i.e., the plurality of support legs 124 is collapsed towards a generally perpendicular position relative to the bottom surface 138 of the platform. Next, as shown in FIG. 31, the antenna 110 and the platform 122 are inserted into the wall cavity 10 through an opening 30 in the finished wall 12. The opening 30 is typically created during installation of the central control panel 22 and is no larger than necessary for mounting the central control panel 22 to the finished wall 12. By collapsing each of the plurality of support legs 124, the platform 122, the antenna 110 and associated wiring 112 can be inserted through the opening 30.

Next, the mounting device 100 is repositioned to an elevated location within the cavity 10 of the finished wall 12 to maximize received signal strength and overall RF performance. In one embodiment of the invention, a non-conductive, flexible rod 135 (shown in FIG. 4B) can be used to push the mounting device 100 up into the wall cavity 10. A recessed cavity 148 is provided in the platform 122 to engage the rod 135 during installation. Once positioned, the weight of the mounting device 100, combined with the tension from the biasing devices 130, forces each fastener 140 into the vertical surface 24 to secure each of the plurality of support legs 24 within the wall cavity 10. Once secured within the finished wall 12, the antenna 110 and the platform 122, as well as the associated wiring 112, are aesthetically concealed.

Figure 4A:
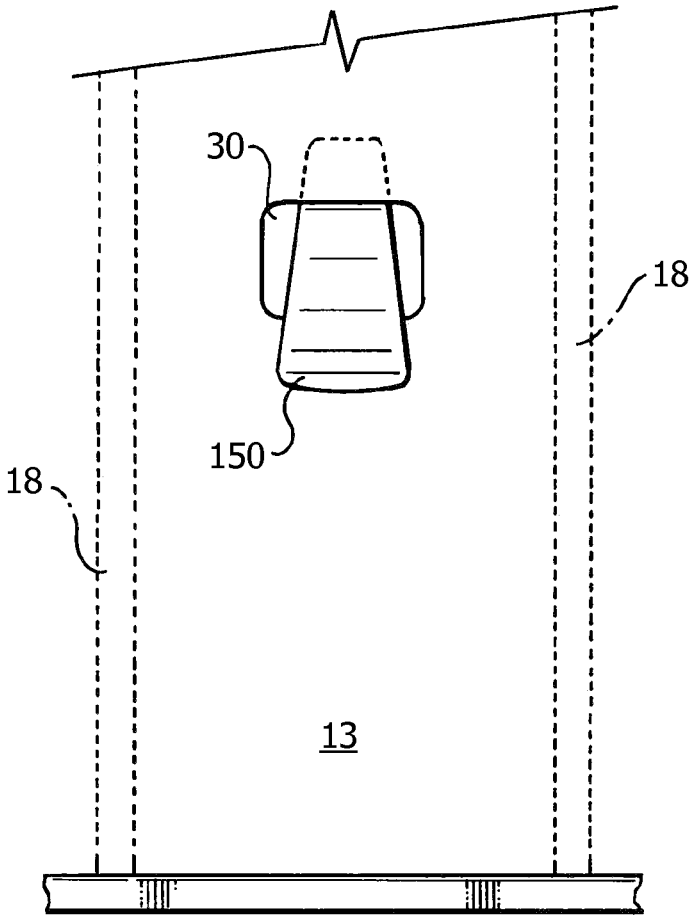
FIG. 4A illustrates a front view of a deflector positioned through an opening in the finished wall.
Figure 4B:
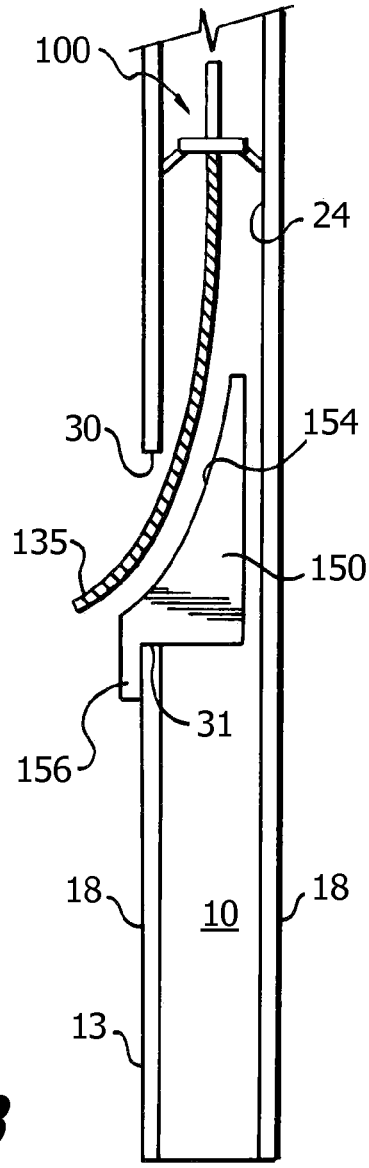
FIG. 4B illustrates a side view of the deflector positioned within the cavity of the finished wall.

As shown in FIGS. 4A-4B, a deflector 150 may be positioned in the wall cavity 10 to guide the mounting device 100 to the elevated position within the wall cavity 10. The deflector 150 is coupled to a bottom edge 31 of the opening 30 and has a sloped surface 154 that can be curvilinear or flat to assist the maneuvering of the mounting device 100 and the flexible rod 135 within the limited space of the wall cavity 10. The sloped surface acts as a ramp so that at least one of the plurality of support legs slides on the sloped surface 154 rather than an inner surface 24 of the finished wall 22 as the mounting device 100 is inserted inside the finished wall 22. The ramping effect acts to propel the mounting device 100 into the elevated position inside the finished wall 22.

The deflector 150 further includes an overhang portion 156 that extends below the opening 30 along an exterior surface 13 of the finished wall 12 to protect the bottom edge 31 of the opening. After the mounting device 100 is secured within the finished wall 12, the deflector 150 is removed. In a preferred embodiment, the deflector 150 may be formed of an injection-molded plastic such as, but not limited to, polystyrene, SAN, ABS, PPO, nylon, polypropylene (PP), polyethylene, PET, polycarbonates (PC), acrylics, K resin, and polyvinyl chloride (PVC), or other similar material.

Accordingly, the present invention provides a method and device for quickly mounting an antenna in an elevated position within a finished wall cavity without having to cut large or additional holes in the finished wall.

While the present invention has been described in an illustrative manner, it should be understood that the terminology used is intended to be in a nature of words of description rather than of limitation. Furthermore, while the present invention has been described in terms of illustrative and alternate embodiments, it is to be appreciated that those skilled in the art will readily apply these teachings to other possible variations of the invention.

I claim:

1. A mounting device for mounting an antenna, comprising:

a platform and a plurality of support legs, each of the plurality of support legs having a free end and a fixed end, the fixed end pivotally coupled to the platform, the platform having a coupling mechanism for attaching an antenna to the platform; and a biasing element for supplying a constant force to the plurality of support legs sufficient to propel the free end of each support leg in an outwardly direction from the platform and engage a surface within a wall cavity to support the mounting device.

2. The mounting device according to claim 1, wherein each of the plurality of support legs comprises a fastener coupled to the free end thereof for securing each of the plurality of support legs to a vertical surface within the wall cavity.

3. The mounting device according to claim 2, wherein the fastener includes a set of barbs.

4. The mounting device according to claim 2, wherein the fastener includes an elastomer end cap.

5. The mounting device according to claim 1, wherein the biasing element includes a spring.

6. The mounting device according to claim 1, wherein the coupling mechanism includes an opening in the platform.

7. The mounting device according to claim 1, wherein each of the plurality of support legs are drawn towards a generally perpendicular position relative to a bottom surface of the platform when the plurality of support legs is collapsed.

8. A method of mounting an antenna comprising:

providing a platform and a plurality of support legs coupled to the platform, the platform having a coupling mechanism for attaching an antenna to the platform;

providing a biasing element for supplying a constant force to the plurality of support legs sufficient to propel a free end of each support leg in an outwardly direction from the platform and engage a surface within a wall cavity to support the platform;

collapsing the plurality of support legs towards a generally perpendicular position relative to a bottom surface of the platform;

inserting the antenna and the platform into the wall cavity through an opening in a finished wall; and securing each of the plurality of support legs to a surface within the wall cavity to support the antenna and the platform.

9. The method according to claim 8, wherein the surface within the wall cavity is a vertical surface.

10. The method according to claim 9, wherein each of the plurality of support legs comprises a fastener coupled to the free end thereof for securing each of the plurality of support legs to the vertical surface.

11. The method according to claim 10, wherein the fastener includes a set of barbs.

12. The method according to claim 10, wherein the fastener includes an elastomer end cap.

13. The method according to claim 8, wherein the biasing element includes a spring.

14. The method according to claim 8, wherein the coupling mechanism includes an opening in the platform.

15. The method according to claim 8, further including positioning a deflector in the wall cavity to guide the antenna and the platform to the elevated position within the wall cavity.

16. The method according to claim 15, wherein positioning the deflector includes sliding at least one of the plurality of support legs along a sloped surface of the deflector.

17. An system for mounting an antenna within a wall cavity, the system comprising:

a platform and a plurality of support legs, each of the plurality of support legs having a free end and a fixed end, the fixed end pivotally coupled to the platform;

a biasing element for supplying a constant force to the plurality of support legs sufficient to propel the free end of each support leg in an outwardly direction from the platform and secure the free end of each of the plurality of support legs to a vertical surface within a wall cavity to maintain the mounting device in an elevated position within the wall cavity; and a deflector positioned in the wall cavity for guiding the antenna and the platform to the elevated position within the wall cavity.

18. The system according to claim 17, wherein each of the plurality of support legs comprises a fastener coupled to the free end thereof for securing the mounting device to the vertical surface.

19. The system according to claim 17, wherein the plurality of support legs is drawn towards a generally perpendicular position relative to a bottom surface of the platform when the plurality of support legs is collapsed and the plurality of support legs is propelled outwardly from the platform to a generally expanded position when the plurality of support legs is secured to the vertical surface within the wall cavity.

20. The system according to claim 17, wherein the deflector includes a sloped surface on which at least one of the plurality of support legs slides as the antenna and platform are positioned in the wall cavity.

21. The system according to claim 17, wherein the deflector includes an overhang portion.

* * * * *